US007835918B2

(12) United States Patent
Myburg et al.

(10) Patent No.: US 7,835,918 B2
(45) **Date of Patent: *Nov. 16, 2010**

(54) ENCODING AND DECODING A SET OF SIGNALS

(75) Inventors: Francois Philippus Myburg, Eindhoven (NL); Dirk Jeroen Breebaart, Eindhoven (NL); Erik Gosuinus Petrus Schuijers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 812 days.

This patent is subject to a terminal disclaimer.

(21) Appl. No.: 11/718,239

(22) PCT Filed: Oct. 31, 2005

(86) PCT No.: PCT/IB2005/053548

§ 371 (c)(1),
(2), (4) Date: Apr. 30, 2007

(87) PCT Pub. No.: WO2006/048815

PCT Pub. Date: May 11, 2006

(65) Prior Publication Data

US 2009/0083040 A1 Mar. 26, 2009

(30) Foreign Application Priority Data

Nov. 4, 2004 (EP) ..... 04105527
Apr. 18, 2005 (EP) ..... 05103082

(51) Int. Cl.
*G10L 19/00* (2006.01)

(52) U.S. Cl. ..... 704/501; 704/200.1

(58) Field of Classification Search ..... 704/200.1, 704/500–504

See application file for complete search history.

(56) References Cited

U.S. PATENT DOCUMENTS 4,827,517 A * 5/1989 Atal et al. ..... 704/218

(Continued)

FOREIGN PATENT DOCUMENTS

EP 0814639 A2 12/1997

OTHER PUBLICATIONS

Matti Karjalainen and Tuomas Paatero: "Generalized Source-Filter Structures for Speech Synthesis" Eurospeech, vol. 4, 2001, p. 2271, XP007004842 Aalborg, Denmark.

(Continued)

*Primary Examiner*—Abul Azad

(57) ABSTRACT

An encoding device (1) and method convert a set of signals (l, r) into a dominant signal (m) containing most signal energy, a residual signal (s) containing a remainder of the signal energy, and signal parameters (IID, ICC) associated with the conversion. The dominant signal (m) and selected parts of the residual signal (s) are encoded. Selecting parts of the residual signal involves a residual signal (s') passing perceptually relevant parts of the residual signal (s), attenuating perceptually less relevant parts of the residual signal and suppressing least relevant parts of the residual signal. An associated decoding device (2) and method decode the encoded dominant signal and the encoded residual signal so as to produce a decoded dominant signal ($m'_u$) and a decoded residual signal ($s'_{mod}$) respectively. A synthetic residual signal ($s'_{Syn}$) is derived from the decoded dominant signal ($m'_u$) and is attenuated so as to produce an attenuated synthetic residual signal ($S'_{Syn,mod}$). The attenuated synthetic residual signal ($S_{syn,mod}$) and the decoded residual signal ($S'_{mod}$) are combined to produce a reconstructed residual signal (s'). The decoded dominant signal (m') and the reconstructed residual signal (s') are then converted into a set of output signals (l', r').

10 Claims, 3 Drawing Sheets

U.S. PATENT DOCUMENTS

Figure 1:
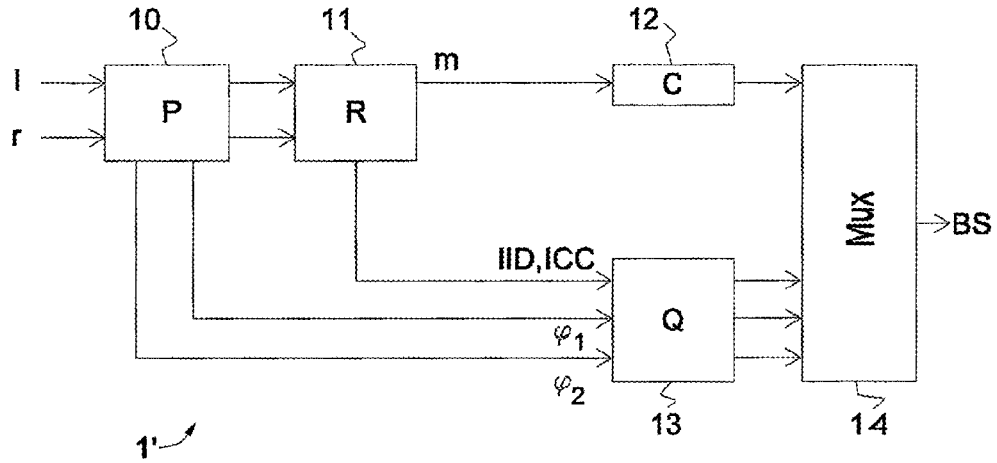
FIG. 1 PRIOR ART

| | | | | |
|---|---|---|---|---|
| 7,394,903 | B2 * | 7/2008 | Herre et al. | 381/23 |
| 7,447,629 | B2 * | 11/2008 | Breebaart | 704/219 |
| 7,573,912 | B2 * | 8/2009 | Lindblom | 370/487 |
| 7,646,875 | B2 | 1/2010 | Schuijers et al. | |
| 2004/0086130 | A1 * | 5/2004 | Eid et al. | 381/20 |
| 2006/0009225 | A1 * | 1/2006 | Herre et al. | 455/450 |

OTHER PUBLICATIONS

Burnett D C et al: "Rapid unsupervised adaptation to children's speech on a connected-digit task" Oct. 3, 1996, Spoken Language, 1996. ICSLP 96. Proceedings., Fourth International Conference on Philadelphia, PA, USA Oct. 3-6, 1996, New York, NY, USA,IEEE, US, pp. 1145-1148 , XP010237826 ISBN: 0-7803-3555-4.

* cited by examiner

ENCODING AND DECODING A SET OF SIGNALS

The present invention relates to signal coding and decoding. More in particular, the present invention relates to a device and a method for encoding a set of input signals, and to a device and method for decoding an encoded set of input signals.

It is well known to encode sets of signals, for example a set of two audio signals (stereo). Traditional coding schemes, such as MPEG-1 Layer III (MP3), employ stereo coding tools to improve the coding efficiency. One of these coding tools is known as Mid/Side (M/S) stereo coding or Sum-difference coding, discussed in the paper by J. D. Johnston and A. J. Ferreira: "Sum-difference stereo transform coding", *Proceedings of the International Conference on Acoustics and Speech Signal Processing* (*ICASSP*), San Francisco, USA, 1992, pp. 1569-572. Sum-difference coding is typically used for encoding a pair of stereo signals.

Using M/S coding a stereo signal consisting of a left signal l[n] and a right signal r[n] is coded as a sum signal m[n] and a difference signal s[n]:

$$m[n]=r[n]+l[n]$$

$$s[n]=r[n]-l[n] \tag{1}$$

For (almost) identical signals l[n] and r[n] this gives a large coding gain as the corresponding difference (or residual) signal s[n] is close to zero, whereas the sum signal contains practically all signal energy. Hence, in this situation the bit rate required for coding the sum and difference signals is close to the bit rate required for coding only a single channel.

Alternatively the Mid-Side coding process can be described by means of a rotation matrix:

$$\begin{pmatrix} m[n] \\ s[n] \end{pmatrix} = c\begin{pmatrix} \cos(\frac{\pi}{4}) & \sin(\frac{\pi}{4}) \\ -\sin(\frac{\pi}{4}) & \cos(\frac{\pi}{4}) \end{pmatrix}\begin{pmatrix} l[n] \\ r[n] \end{pmatrix} \tag{2}$$

Here, the left and right signals have been rotated over an angle of $\pi/4$. The sum signal can be interpreted as a projection of the left and right samples onto the line l=r, whereas the difference signal can be interpreted as a projection of the left and right samples onto the line l=−r.

In order to minimize the signal power in the residual signal (i.e., maximizing the coding gain) for a wide class of input signals, the rotation angle needs to be signal dependent. The following unitary rotation can be applied to the left and right channels:

$$\begin{pmatrix} m[n] \\ s[n] \end{pmatrix} = c\begin{pmatrix} \cos(\alpha) & \sin(\alpha) \\ -\sin(\alpha) & \cos(\alpha) \end{pmatrix}\begin{pmatrix} l[n] \\ r[n] \end{pmatrix} \tag{3}$$

where m[n] and s[n] represent the dominant and the residual signal respectively and the angle $\alpha$ is chosen to minimize the power of the residual signal, thus maximizing the power of the dominant signal.

The rotation according to formula (3) allows a significant bit rate reduction of the residual signal. However, for a perfect reconstruction the angle $\alpha$ (or a parameter indicative of the angle $\alpha$) is required, and it has been found that transmitting the angle $\alpha$ for each time segment cancels out a large part of the bit rate savings made by the rotation technique.

It has further been proposed to reduce the required bit rate by discarding the residual signal s[n]. However, at relatively low frequencies (typically below 5 kHz) the absence of the residual signal s[n] results in an audible signal degradation. It has been found that this is largely due to phase or time offsets in the low-frequency signals. To allow for such offsets, the signal rotation technique may be extended by employing complex-valued phase rotations to the left and right signal components.

It will be assumed that the left and right signals are represented by their complex-valued frequency domain representations l[k] and r[k], and are restricted to a single signal segment or frame. Methods applied to obtain a frequency-domain representation from time-domain (windowed) left and right signals, and vice versa, include the Discrete Fourier Transform (DFT), the Short-Time (Digital) Fourier Transform (STFT) and complex-modulated filter banks. To compensate for phase differences between the left and right signals, the signal model is extended in the following way:

$$\begin{pmatrix} m[k] \\ s[k] \end{pmatrix} = \begin{pmatrix} \cos(\alpha) & \sin(\alpha) \\ -\sin(\alpha) & \cos(\alpha) \end{pmatrix}\begin{pmatrix} e^{-j\varphi_1} & 0 \\ 0 & e^{-j(\varphi_1-\varphi_2)} \end{pmatrix}\begin{pmatrix} l[k] \\ r[k] \end{pmatrix} \tag{4}$$

In this expression, a complex-valued phase modification matrix is applied to compensate for phase differences between left and right. The angle $\phi_2$ is used to minimize the energy of the residual signal by (phase) rotating the right signal. The common angle $\phi_1$ can be used to maximize the continuation of the signal over frame boundaries. After measuring and applying phase synchronization, the rotation angle $\alpha$ is determined from the (frequency and time variant) inter-channel intensity difference (IID) and inter-channel coherence (ICC), or similarity, between the left and right input channels.

After signal mapping and/or modification the dominant and residual time domain signals m[n] and s[n] are obtained by first applying the inverse DFT (or any other suitable inverse transform) on the frequency domain representations m[k] and s[k].

In parametric stereo coding systems, the bit rate is lowered considerably by discarding (that is, not transmitting) the residual signal. In the decoding device (receiver), a synthetic residual signal is produced, typically by deriving this signal from the dominant signal m[n].

While parametric stereo coders are able to obtain a high audio quality at low bit rates, the main disadvantage of these coders is that an increase in the bit rate does not lead to a proportional increase in the audio quality. This is largely due to the fact that the synthetic residual signal generated by the decoding device will generally not resemble the discarded actual residual signal, even when it has similar spatial parameters (IID, ICC).

To overcome this saturation in audio quality at higher bit rates, it has been proposed to encode a part of the residual signal. The resulting system is called a hybrid stereo coder, since an audio coder codes a specified part of the residual signal (e.g. the low frequency band), and the remainder of the residual signal is provided by the synthetic residual signal combined with binaural (that is, spatial) parameters. To limit the increase in bit rate due to coding the residual signal, while maintaining the improved audio quality, only those time-frequency parts of the residual signal that contribute to the audio quality are selected. This yields an increase in audio quality with increasing bit rate as more time-frequency parts of the residual signal can be selected and coded.

However, it has been found that the selection of parts of the residual signal leads to relatively abrupt changes the required bit rate. These changes in the required bitrate can not always be accommodated due to bitrate restriction of the encoding device or of the transmission channel. As a result, the signal quality may adversely affected. Furthermore, any abrupt switching in the decoding device between the transmitted residual signal and the synthetic residual signal results in audible switching artifacts.

It is an object of the present invention to overcome these and other problems of the Prior Art and to provide a device and a method of encoding a set of signals which allow a less abrupt change in the transmitted residual signal.

It is a further object of the present invention to provide a device and method of decoding a set of signals which better handle changes in the transmitted residual signal. Accordingly, the present invention provides an encoding device for encoding a set of input signals, the device comprising:

conversion means for converting the set of input signals into a dominant signal containing most signal energy, a residual signal containing a remainder of the signal energy, and signal parameters associated with the conversion, selection means for selecting parts of the residual signal, and encoding means for encoding the dominant signal and the selected parts of the residual signal, wherein the selection means are arranged for substantially passing perceptually relevant parts of the residual signal, attenuating perceptually less relevant parts of the residual signal and suppressing least relevant parts of the residual signal.

Those time-frequency parts of the residual which are perceptually vital for obtaining a high audio quality are identified by the selection means and are left substantially unchanged. Less important parts of the residual signal are identified and appropriately attenuated, while unimportant parts are removed. By attenuating less relevant parts of the residual signal, the bit rate required for coding this signal is reduced while the increase in audio quality obtained by coding the residual signal is maintained.

The selection means may further be controlled by the available transmission rate. That is, the selection may be adjusted or controlled in dependence of the transmission and/or storage capacity, selecting more parts of the residual signal and/or attenuating selected parts less when the transmission rate increases, and vice versa. This may, for example, be accomplished by making perceptual relevance thresholds dependent on the available transmission rate (bitrate).

Additionally, the present invention provides a conversion device for converting a dominant signal containing most signal energy and a residual signal containing a remainder of the signal energy into a set of output signals, the device comprising:

decorrelation means for producing a synthetic residual signal, attenuation means for attenuating the synthetic residual signal so as to produce an attenuated synthetic residual signal, and processing means for processing the dominant signal and the attenuated synthetic residual signal so as to produce the output signals, wherein the attenuation means are arranged for being controlled by the residual signal.

More in particular, the present invention also provides a decoding device for decoding an input signal containing an encoded dominant signal containing most signal energy, an encoded residual signal containing a remainder of the signal energy, and associated signal parameters, the device comprising:

decoding means for decoding the encoded dominant signal and the encoded residual signal so as to produce a decoded dominant signal and a decoded residual signal respectively, decorrelation means for deriving a synthetic residual signal from the decoded dominant signal, attenuation means for attenuating the synthetic residual signal so as to produce an attenuated synthetic residual signal, scaling means for scaling the decoded dominant signal and the attenuated synthetic residual signal so as to produce a reconstructed dominant signal and a scaled attenuated synthetic residual signal, combination means for combining the decoded residual signal and the scaled attenuated synthetic residual signal so as to produce a reconstructed residual signal, and conversion means for converting the decoded dominant signal and the reconstructed residual signal into a set of output signals using signal parameters, wherein the attenuation means are arranged for being controlled by the decoded residual signal.

By providing attenuation means for attenuating the synthetic residual signal in accordance with the decoded residual signal, significantly improved reconstructed output signals are obtained. In addition, a gradual transition from the synthetic residual signal to the decoded residual signal, and vice versa, may be obtained, thus avoiding any switching artifacts. As a result, at a given bitrate a much higher audio quality may be achieved than in the Prior Art, or conversely, a similar audio quality may be achieved at a lower bitrate.

In the decoding device, those time-frequency parts of the residual signal that are not contained in the decoded residual signal, or were attenuated, are supplemented by a suitably adapted synthetic residual signal to result in a combined residual signal. Though possible, it is not essential to provide additional information specifying which time-frequency parts, and how much, of the synthetic residual signal should be used in the decoder. Instead, the attenuation of the synthetic residual signal can be based on the binaural parameters (e.g. IID and ICC), the decoded modified residual signal and the decoded dominant signal.

In a preferred embodiment of the inventive decoding device, the attenuation means are arranged for additionally receiving the decoded dominant signal and/or (dequantized) signal parameters.

The decoding device of the present invention may further comprise inverse phase rotation means for performing an inverse phase rotation of the output signals.

In an alternative embodiment of the decoding device according to the present invention the combination means are arranged between the attenuation means and the scaling means so as to combine the decoded residual signal and the attenuated synthetic residual signal prior to scaling. In this embodiment, therefore, the decoded residual signal is first combined with the attenuated synthetic residual signal and then fed to the scaling means. In the preferred embodiment, the decoded residual signal is combined with the scaled attenuated synthetic residual signal.

The present invention further provides a method of encoding a set of input signals, the method comprising the steps of:

converting the set of input signals into a dominant signal containing most signal energy, a residual signal containing a remainder of the signal energy, and signal-parameters associated with the conversion, selecting parts of the residual signal, and encoding the dominant signal and the selected parts of the residual signal, wherein the selection step comprises the sub-steps of substantially passing perceptually relevant parts of the residual signal, attenuating perceptually less relevant parts of the residual signal and suppressing least relevant parts of the residual signal.

The present invention still further provides a method of decoding an input signal containing an encoded dominant signal containing most signal energy, an encoded residual signal containing a remainder of the signal energy, and associated signal parameters, the method comprising the steps of:

decoding the encoded dominant signal and the encoded residual signal so as to produce a decoded dominant signal and a decoded residual signal respectively, deriving a synthetic residual signal from the decoded dominant signal, attenuating the synthetic residual signal so as to produce an attenuated synthetic residual signal, scaling the decoded dominant signal and the attenuated synthetic residual signal so as to produce a reconstructed dominant signal and a scaled attenuated synthetic residual signal, combining the synthetic residual signal and the attenuated synthetic residual signal so as to produce a residual signal, and converting the decoded dominant signal and the reconstructed residual signal into a set of output signals using signal parameters, wherein the attenuating step is controlled by the decoded residual signal.

Further method steps in accordance with the present invention will become apparent from the description below.

The present invention additionally provides a computer program product for carrying out the encoding and/or decoding methods as defined above. A computer program product may comprise a set of computer executable instructions stored on a data carrier in the form of a computer readable storage medium, such as a CD or a DVD. The set of computer executable instructions, which allow a programmable computer to carry out the methods as defined above, may also be available for downloading from a remote server, for example via the Internet.

The present invention will further be explained below with reference to exemplary embodiments illustrated in the accompanying drawings, in which:

FIG. 1 schematically shows a parametric stereo encoding device according to the Prior Art.

Figure 2:
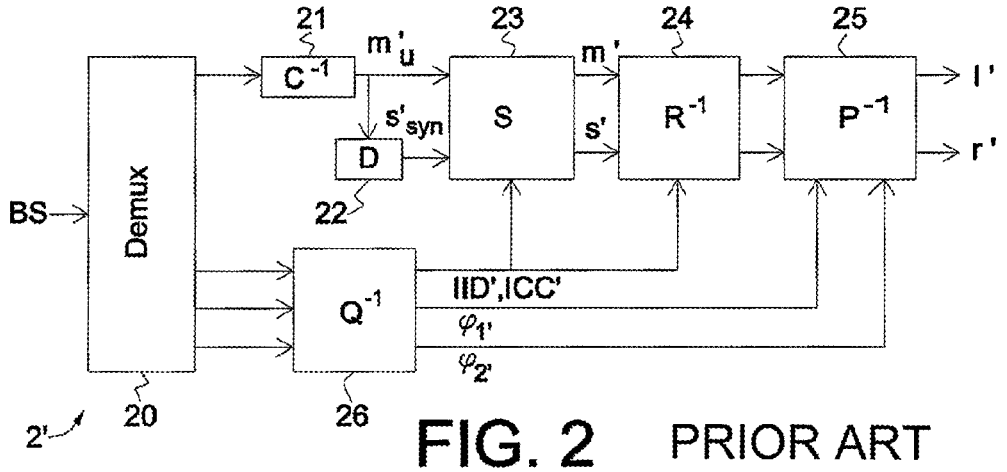
FIG. 2 PRIOR ART

FIG. 2 schematically shows a parametric stereo decoding device according to the Prior Art.

Figure 3:
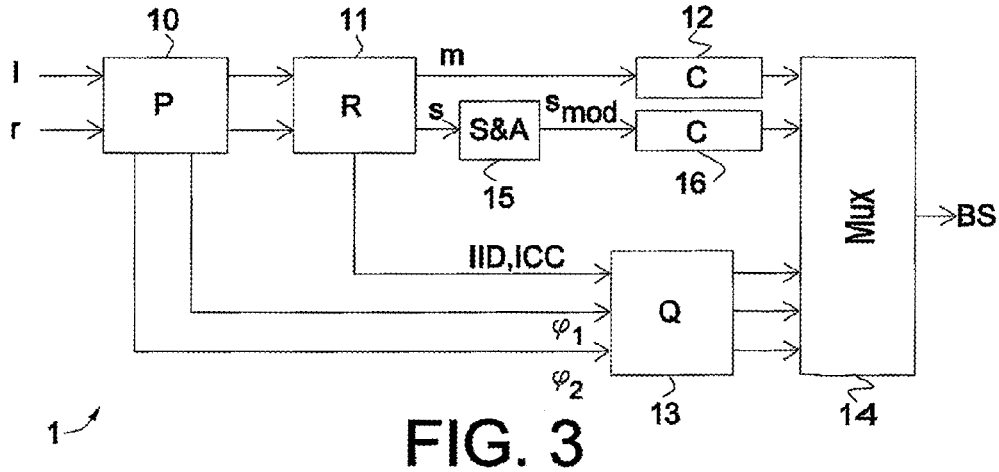

FIG. 3 schematically shows a parametric stereo encoding device according to the present invention.

Figure 4:
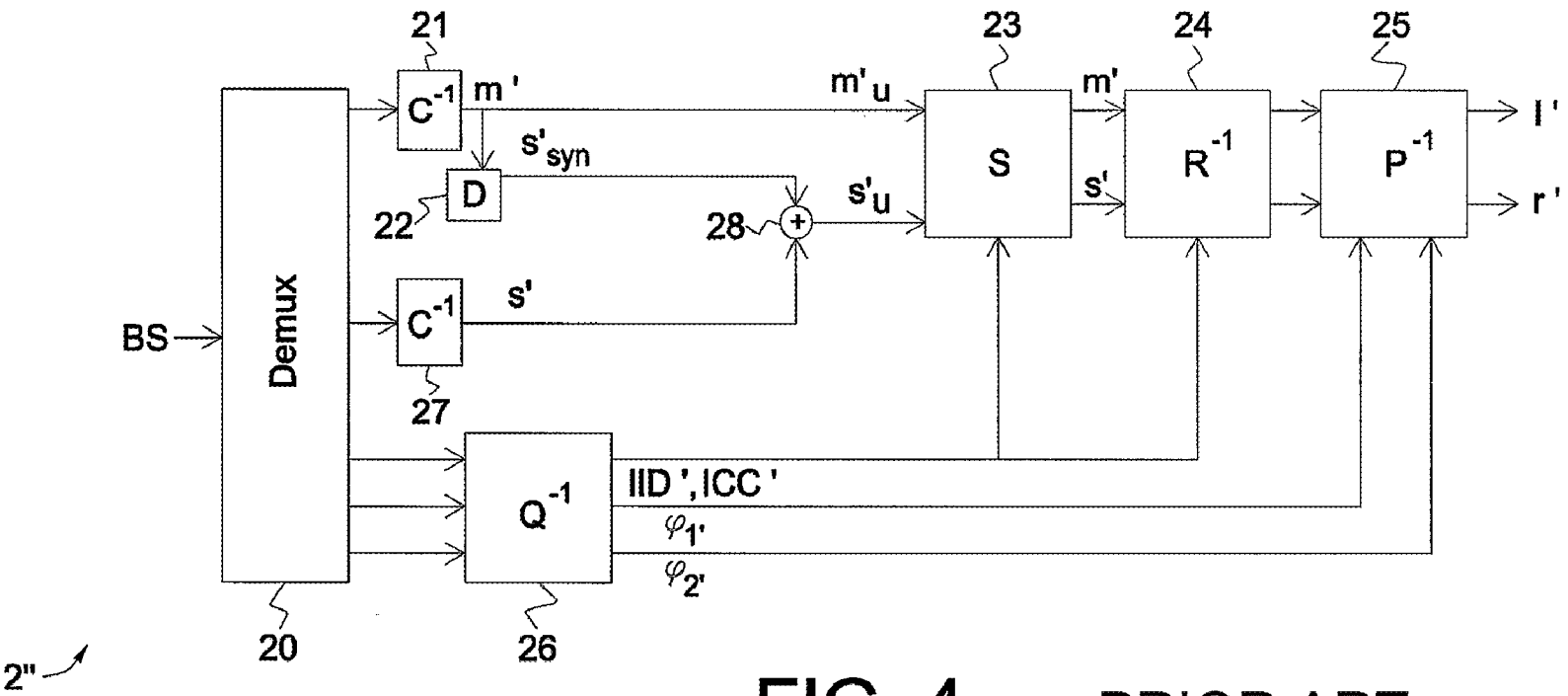
FIG. 4 PRIOR ART

FIG. 4 schematically shows a parametric stereo decoding device according to the Prior Art.

FIG. 5 schematically shows a parametric stereo decoding device according to the present invention.

FIG. 6 schematically shows a parametric stereo decoding device according to the present invention.

Figure 7:
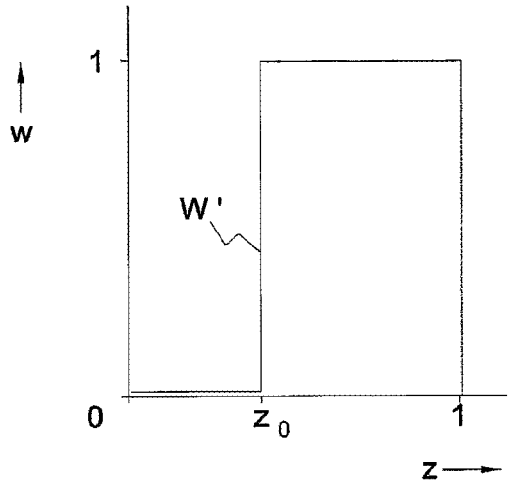
FIG. 7 PRIOR ART

FIG. 7 schematically shows a signal selection function according to the Prior Art.

Figure 8:
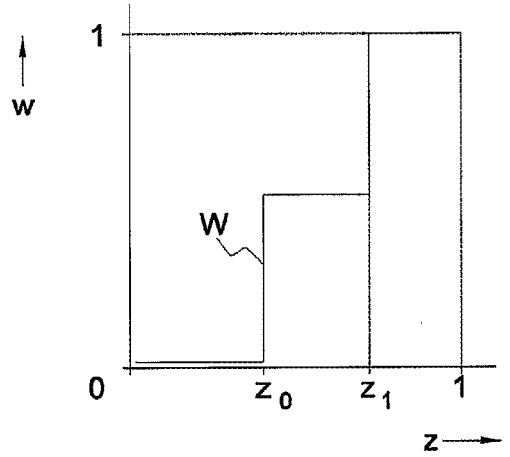

FIG. 8 schematically shows a first signal selection function according to the present invention.

Figure 9:
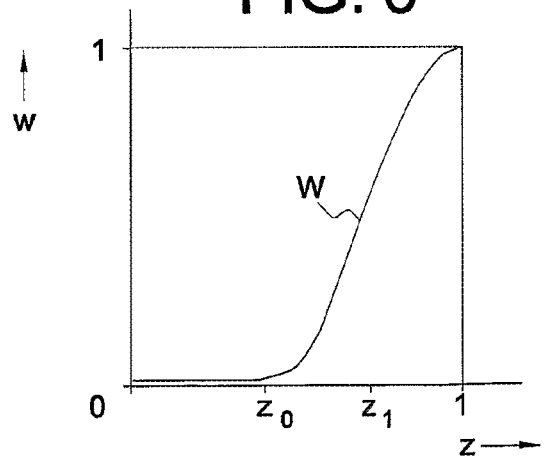

FIG. 9 schematically shows a second signal selection function according to the present invention.

FIG. 10 schematically shows a selection and attenuation unit according to the present invention.

The Prior Art encoding device 1' shown in FIG. 1 comprises a phase modification (P) unit 10, a signal rotation (R) unit 11, a coding (C) unit 12, a quantization (Q) unit 13 and a multiplexing (Mux) unit 14. The phase modification unit 10 receives a set of input signals. In the example shown, the encoding device 1' is a stereo encoder and the set of input signals consists of a left signal l and a right signal r. The signals l and r typically consist of time segments, such as time frames, which may be subjected to a short-time Fourier transform (STFT) or a similar transformation to yield short-time frequency spectrum representations. In the following it will be assumed that the signals l and r are frequency spectrum representations of time segments and may be thought of as consisting of time/frequency units. Any STFT transform units or their equivalents, such as windowing units and FFT (Fast Fourier Transform) units, are not shown in FIG. 1 but may be present. Such transform units are well known in the Art.

The phase modification unit 10 performs a phase adjustment of the signal pair l, r using phase angles $\phi_1$ and $\phi_2$. The first, common phase angle $\phi_1$ may be used to maximize the continuation of the signals over frame (time segment) boundaries, while the second phase angle $\phi_2$ may be used to minimize the energy of one of the signals (typically the residual signal to be discussed later) by rotating one of the signals, for example the right signal r. The phase angles $\phi_1$ and $\phi_2$ are input to the quantization unit 13.

The signal rotation (R) unit 11 receives the phase-adjusted signals l and r and performs a signal rotation to produce a dominant signal m and a residual signal s. The signals l and r are rotated in such a manner that the dominant signal m contains most (preferably all) signal energy and the residual signal s contains little (preferably no) signal energy. The signals l and r may further be rotated in such a way that the correlation between the dominant signal m and the residual signal s is lower than the correlation of the signals l and r.

In the example of FIG. 1, the residual signal s is discarded and only the dominant signal m is encoded by the (en)coding unit C. The signal rotation unit 11 produces signal parameters, such as a rotation angle $\alpha$, an inter-channel intensity difference parameter IID and an inter-channel coherence parameter ICC. Some or all of parameters are fed to the quantization unit 13. As these parameters are related, the rotation angle $\alpha$ is typically not required.

The quantization unit 13 quantizes the signal parameters, in the example shown the phase angles $\phi_1$ and $\phi_2$, the rotation angle $\alpha$ and the parameters IID and ICC, to produce quantized parameters. These quantized parameters are fed to the multiplexing unit 14, as is the encoded dominant signal m, and multiplexed into a bit stream BS.

A compatible decoding device according to the Prior Art is schematically shown in FIG. 2. The decoding device 2' comprises a demultiplexer (Demux) 20, a decoding ($C^{-1}$) unit 21, a decorrelation (D) unit 22, a scaling (S) unit 23, an inverse signal rotation ($R^{-1}$) unit 24, an inverse phase modification ($P^{-1}$) unit 25, and an inverse quantization ($Q^{-1}$) unit 26.

The demultiplexer unit 20 demultiplexes a bit stream BS, feeding an encoded dominant signal to the decoding unit 21 and quantized signal parameters to the dequantization unit 26. The decoding unit 21 produces a decoded dominant signal $m'_u$ which is fed to both the decorrelation unit 22 and the scaling unit 23. The decorrelation unit 22 produces a signal $s'_{syn}$ which is a decorrelated version of the decoded dominant signal $m'_u$ and which serves, after scaling, as a substitute for the residual signal s which was, in this example, not transmitted. Accordingly, this synthetic residual signal $s'_{syn}$ is also fed to the scaling unit 23, together with the decoded dominant signal $m'_u$ and the dequantized signal parameters IID' and ICC'. The scaling unit 23 scales the decoded dominant signal $m'_u$ and the synthetic residual signal $s'_{syn}$ and feed the resulting pair of signals m' and s' to the inverse rotation unit 24, where this signal pair is inversely rotated using the dequantized rotation angle α'. It will be understood that the scaled residual signal s' is an approximation of the residual signal s in the encoding device.

Finally, the phase of the inversely rotated signals is adjusted by the inverse phase ($P^{-1}$) modification unit 25, using the dequantized phase angles $\phi_1'$ and $\phi_2'$. The resulting signals l' and r' are output. As the signals l' and r' are time/frequency representations of time signals, they may subsequently be transformed to the time domain using an inverse STFT or a similar transformation.

The encoding device l' and the decoding device 2' of the Prior Art achieve a high degree of data compression as the parameters are quantized and the residual signal is discarded. However, these known devices have the disadvantage that they do not allow a higher signal quality for higher bit rates. That is, when the transmission rate of the bit stream BS is increased, the quality of the output signals l' and r' hardly increases. In other words, a saturation in audio quality occurs. This makes these known devices less suitable for applications where higher transmission rates may be available.

An improvement on the Prior Art devices discussed above is offered by encoding devices which also transmit the residual signal instead of discarding it, and decoding devices capable of using a transmitted residual signal to improve the signal quality. Such devices are described in European Patent Application EP 04103168.3 filed 5 Jul. 2004, corresponding to U.S. patent application Ser. No. 10/599,564, filed Oct. 2, 2006, now U.S. Pat. No. 7,646,875, and corresponding applications, the entire contents of which are herewith incorporated in this document.

To reduce the transmission rate required to transmit the (encoded) residual signal in addition to the encoded dominant signal and quantized parameters, it is proposed in the above-mentioned European Patent Application to encode and transmit only part of the residual signal. That is, a selection is made and only perceptually relevant parts of the residual signal are encoded and transmitted. This is accomplished by discarding perceptually irrelevant information in the residual signal, thus encoding only selected parts.

The selection according to the above-mentioned European Patent Application is schematically illustrated in FIG. 7, which shows a weighting function W'. The weight w assigned to parts of the residual signal depends on a relevance factor z, which may be the ratio of the power of the residual signal s and the power of the dominant signal m: z=P(s)/P(m), or any other factor indicative of the (relative) perceptual relevance of the residual signal. When the relative power of the residual signal exceeds a certain threshold value $z_0$, the weighting factors w equals 1, which means that the residual signal part is fully encoded and transmitted. When the relative power of the residual signal is smaller than the threshold value $z_0$, the weighting factor w is equal to 0 and the relevant part of the residual signal is discarded.

The present inventors have realized that this selection is too coarse and that the on and off switching of the residual signal according to the Prior Art causes switching artifacts. In particular, the present inventors have realized that the quality of the decoded signals can be improved without significantly increasing the quantity of transmitted data. Accordingly, the present invention provides a selection of (parts of) the residual signal that distinguishes not only between relevant and non-relevant parts, but also identifies less relevant parts: parts that are not as relevant as the (most) relevant parts but are not irrelevant either.

Examples of a weighting function W according to the present invention are schematically shown in FIGS. 8 and 9. In the example of FIG. 8, the weighting function W has two threshold values $z_0$ and $z_1$. If z is less than $z_0$, the weighting factor w is equal to zero and hence the residual signal is discarded entirely. If z is greater than $z_0$ but less than $z_1$, the weighting factor w is (in the present example) equal to 0.5 (it will be understood that other values, such as 0.25 or 0.67, may also be used). In this region of the weighting function, the residual signal is not discarded but attenuated. If z is greater than $z_1$, w is equal to one and the entire residual signal is used, substantially without being attenuated.

In the example of FIG. 9, the weighting factor w increases gradually from 0 (at $z=z_0$) via 0.5 (at $z=z_1$) to 1.0 (at z=1). As a result, only the most relevant signal parts (z=1) have a weighting factor equal to 1, and all signal parts having a relevance factor z greater than $z_0$ have a non-zero weighting factor w. Of course other functions may be used than the ones illustrated in FIGS. 8 and 9. In general, the weighting function will have the property that those parts of the residual signal that make no significant contribution to the audio quality of the reconstruction of the original signal pair l, r are removed, parts of the residual signal having an intermediate perceptual relevance are being attenuated and highly significant parts are passed substantially unattenuated.

A merely exemplary embodiment of an encoding device according to the present invention is illustrated in FIG. 3. The inventive encoding device 1 also comprises a phase modification (P) unit 10, a signal rotation (R) unit 11, a coding (C) unit 12, a quantization (Q) unit 13 and a multiplexing (Mux) unit 14. In addition, the encoding device 1 comprises a selection and attenuation (S&A) unit 15 and an additional coding (C) unit 16. The selection and attenuation unit 15 will later be discussed in more detail with reference to FIG. 10.

As in the Prior Art devices, the phase modification unit 10 receives a set of input signals. In the non-limiting example shown in FIG. 3, the encoding device 1 is a stereo encoder and the set of input signals consists of a left signal l and a right signal r. The signals l and r typically consist of time segments, such as time frames, which may be subjected to a short-time Fourier transform (STFT) or a similar transformation to yield short-time frequency spectrum representations. In the following it will be assumed that the signals l and r are frequency spectrum representations of time segments and may be thought of as consisting of time/frequency units.

In the encoding device 1 of FIG. 3, the residual signal s produced by the signal rotation unit 11 is not discarded but fed to the selection and attenuation (S&A) unit 15 which then selects a frame in accordance with a weighting function, for example the weighting function W illustrated in FIG. 8 or FIG. 9. In accordance with the present invention, this selection may also involve an attenuation: the weighting factor (w in FIG. 8) may have any value from 0 to 1 (assuming the weighting factor is normalized), where non-zero values imply selection and non-zero values smaller than 1 also imply attenuation.

It is noted that the selection and attenuation unit 15 is arranged for selecting time/frequency units of the residual signal, which units are referred to as frames for the sake of convenience. However, it is not necessary for these units or "frames" to comply with any existing protocol defining frames.

The weighted residual signal $s_{mod}$ is fed to the second or additional encoding unit 16, the output of which is fed to the multiplexing unit 14 to be multiplexed into the bit stream BS.

Although the exemplary encoding device 1 of FIG. 3 is provided with a phase modification unit 10, such a unit is not essential and may be omitted if no phase modification is required. Similarly, the quantization unit 13 may be omitted if no quantization and associated data reduction is required.

In the device 1 of FIG. 3 the signal parameters IID, ICC, phase angles $\phi_1$ and $\phi_2$ and any other parameters (such as the rotation angle $\alpha$) are determined in the units 10 and 11, used for a phase and/or rotation adjustment, and then quantized in the quantization unit 13 to reduce the amount of data required for transmission of these parameters. In an alternative embodiment, the parameters are determined in the units 10 and 11 as in the present embodiment, but are then quantized in the quantization unit 13 and subsequently fed back to the phase and signal rotation units 10 and 11 to effect the phase and rotation adjustments. As a result, the quantized parameters are used by the units 10 and 11, instead of the unquantized parameters. This has the advantage that the phase and rotation adjustments are controlled by the same (quantized) parameter values as will be used in the decoding device, thus avoiding any discrepancies due to the quantization.

It is noted that European Patent Application EP 04103168.3 (PHNL040762) mentioned above discloses an encoding device having a similar structure. However, in the Prior Art encoding device a frame selector replaces the selection and attenuation 15 of the present invention. The frame selector of the Prior Art is arranged for distinguishing between only two levels of perceptual relevance: relevant or irrelevant. In contrast, the encoding device of the present invention has a selecting and attenuation (S&A) unit arranged for distinguishing between three or more (in general: multiple) levels of perceptual relevance, such as: relevant, less relevant and irrelevant, and any additional desired level in between.

It can thus be seen that the encoding device 1 of the present invention additionally encodes a modified version $s_{mod}$ of the residual signal s, the modification comprising both a selection (that is, discarding some signal parts/units) and an attenuation (that is, of some selected signal parts/units) so as to reduce the required transmission rate. By additionally encoding some attenuated signal parts, the quality of the decoded signal may be improved.

In this respect it may be noted that the weighting function (W in FIGS. 8 and 9) may be adjusted in accordance with the available bandwidth (maximum transmission rate). The weighting function W of FIG. 9, for example, may be shifted to the left when more bandwidth becomes available, thereby reducing both the attenuation and the lower threshold $z_0$. Conversely, the function W may be shifted to the right (or multiplied with a positive number smaller than 1) when the available bandwidth (that is, transmission capacity) is reduced. The weighting function W of FIG. 8 or 9 may even be time-dependent, frequency-dependent or both. For example, lower frequencies could be attenuated less than higher frequencies. Using a weighting function W or its equivalent, a controlled selection and weighting is achieved.

The selection and attenuation.(S&A) unit 15 of FIG. 3 is shown in more detail in FIG. 10. The merely exemplary selection and attenuation unit 15 of FIG. 10 is shown to comprise a signal analysis (X) section 151 and an attenuation (A) section 152. The signal analysis section 151 receives the residual signal s and determines its (perceptual) relevance, for example by determining its power per frequency range. Although not shown in FIG. 10, the signal analysis section 151 could additionally receive the dominant signal m to provide an improved estimate of the perceptual relevance of the residual signal s.

Both the residual signal s and the relevance information are passed on to the attenuation section 152 which attenuates the residual signal s in dependence of the relevance information produces by the signal analysis section 151. Some signal parts (such as time/frequency segments) are passed without being attenuated, other are completely attenuated (and therefore blocked), while still others are in accordance with the present invention partially attenuated, that is, these signal parts are passed but their power is reduced. The signal $S_{mod}$ will consist of unattenuated signal parts, partially attenuated signal parts and "empty" (completely attenuated) signal parts, and will therefore have less power (and hence a smaller amplitude) than the original residual signal s and can be coded more efficiently.

The attenuation section 152 may receive bitrate (BR) information which enables the section to adjust the attenuation in dependence of the available bitrate.

Other embodiments of the selection and attenuation unit 15 can be envisaged, for example embodiments in which a switching function is present to block certain signal parts. Also, the bitrate (BR) information may be fed to the selection section 151 instead of to the attenuation section 152.

In addition to the encoding device described above, the present invention also provides decoding devices for decoding signals that have been encoded using the encoding device of the present invention, or using compatible devices.

A decoding device 2" as described in EP 04103168.3 (PHNL040762) mentioned above is schematically illustrated in FIG. 4. The decoding device 2" comprises a demultiplexing (Demux) unit 20, a first decoding ($C^{-1}$) unit 21, a second decoding ($C^{-1}$) unit 27, a decorrelation (D) unit 22, a combination (+) unit 28, a scaling (S) unit 23, an inverse rotation ($R_{-1}$) unit 24, an inverse phase modification ($P^{-1}$) unit 25, and a dequantization ($Q^{-1}$) unit 26. The decoding device 2" of FIG. 4 differs from the decoding device 2' of FIG. 2 in that a second decoder 27 is present which produces a decoded modified residual signal $s'_{mod}$. This decoded modified residual signal $s'_{mod}$ is combined with the synthetic residual signal $s'_{syn}$ produced by the decorrelation unit 22 to provide a reconstructed (unscaled) residual signal $s'_u$. In the decoding device 2", therefore, the (reconstructed and unscaled) residual signal $s'_u$ fed to the scaling unit 23 to produce the (reconstructed) residual signal s' is the combination (typically the sum) of the synthetic residual signal and the decoded modified (that is, selected and scaled) residual signal.

However, the decoded modified residual signal $s'_{mod}$ is often equal to zero or very small. When this signal is equal to zero, the residual signal $s'_u$ fed to the scaling unit 23 is equal to the synthetic residual signal $s'_{syn}$, the amplitude and/or energy of which is basically equal to the amplitude of the decoded modified signal m', and when the decoded modified residual signal $s'_{mod}$ is small, decoding (quantization) noise may be relatively large and introduce distortion. Furthermore, the power of the combined residual signal $s'_u$produced by the combination unit 28 varies with the signal $s'_{mod}$, which causes an further discrepancy with the original residual s. In addition, the "switching" between the two residual signals causes signal discontinuities.

The present invention solves this problem by providing an attenuation unit controlled by the decoded residual signal $s'_{mod}$. This allows the (power and/or amplitude of the) synthetic residual signal $s'_{syn}$ to be controlled by the (power and/or amplitude of the) decoded modified residual signal $s'_{mod}$. In this way, the combined power of these signals corresponds with the power of the original residual signal s produced in the encoding device and any switching artifacts are substantially avoided. Any parts of the original residual signal s that were not transmitted can thus be appropriately compensated by the synthetic residual signal $s'_{syn}$.

The inventive decoding device 2 shown merely by way of non-limiting example in FIG. 5 comprises, in addition to the components mentioned before, an attenuation (A) unit 29. This attenuation unit 29 receives the synthetic residual signal $s'_{syn}$ and produces a modified synthetic residual signal $s'_{syn,\ mod}$ which is fed to the scaling unit 23. The attenuation unit 29 is controlled by the decoded residual signal $s'_{mod}$ and also receives the (unscaled) decoded dominant signal $m'_u$ and, optionally, dequantized signal parameters IDD' and ICC'. As a result, the amplitude (or power) of the combined residual signal s' (which is, in the present embodiment, equal to the sum of $s'_{syn,\ mod}$ and $s'_{mod}$) can be made substantially equal to the amplitude (or power) of the original residual signal s. As a result, the spatial properties of the output signals l' and r' can be made to match the spatial properties of the original signals l and r. By using the received (decoded) residual signal $s'_{mod}$ when available, any detrimental effects caused by the synthetic residual signal $s'_{syn}$ not having the exact waveforms are minimized.

In this preferred embodiment, the modified (that is, attenuated) synthetic residual signal $s'_{syn,\ mod}$ is first scaled by the scaling unit 23 and then combined with the decoded residual signal $s'_{mod}$. The scaling unit 23, which may receive decoded signal parameters (for example IID' and ICC') from the dequantization unit 26, scales the signals $m'_u$ and $s'_{syn,\ mod}$ and accordingly adjusts their relative amplitudes (and/or relative power).

The attenuation of the synthetic residual signal $s'_{syn}$ is performed as follows. The energy in the dominant signal may be expressed as:

$$E_{m'} = \sum_k |m'[k]|^2 \tag{4}$$

and the energy in the residual signal as:

$$E_{s'_{mod}} = \sum_k |s'_{mod}[k]|^2. \tag{5}$$

The energy in the synthetic residual signal (after scaling) is derived from $E_{m'}$ by $$E_{s'_{syn}} = E_{m'} \cdot \sin^2(\gamma). \tag{6}$$

Here, sin(γ) is the scaling factor applied to the synthetic residual signal, γ is the ratio between the dominant and (unmodified) residual signals derived from the inter-channel coherence and intensity difference binaural parameters $$\gamma = \arctan\left(\sqrt{\frac{1-\sqrt{\upsilon}}{1+\sqrt{\upsilon}}}\right), \text{ where} \tag{7}$$

-continued $$\upsilon = 1 + \frac{4\rho^2 - 4}{(c - 1/c)^2}. \tag{8}$$

The factor c is derived from the intensity differences as $$c = 10^{IID/20}. \tag{9}$$

The appropriate weighting of the synthetic residual signal is then determined by $$w_{s'_{syn}} = \frac{E_{s'_{syn}} - E_{s'_{mod}} \cdot \cos^2(\gamma)}{E_{s'_{syn}}} \tag{10}$$

where cos(γ) is the scaling factor applied to the decoded dominant signal $m'_u$.

The modified synthetic residual signal $s'_{syn,mod}[n]$ is then determined as $$s'_{syn,mod}[n] = s'_{syn}[n]\sqrt{w_{s'_{syn}}}. \tag{11}$$

This attenuation is preferably not applied to the broadband signal $s'_{syn}[n]$, but rather to signals (or frequency domain representations) each representing only a smaller part of the full bandwidth of the audio signal, that is, suitable time/frequency segments.

It is noted that some units of the decoding device 2 are optional. For example, the inverse phase unit 25 may be deleted if no phase modification is required. A decoding device 2 which is changed in this way is illustrated in FIG. 6. In the decoding device of FIG. 6, the combination unit 28 is arranged between the attenuation unit 29 and the scaling unit 23, such that the decoded residual signal $s'_{mod}$ is combined with the attenuated synthetic residual signal $s'_{syn,\ mod}$ prior to scaling. It will be understood that the features of the embodiments of FIGS. 5 and 6, and of other Figures, may be interchanged so as to provide further embodiments which have not been illustrated.

The dequantization unit 26 may be deleted if the parameters transmitted are not quantized. The demultiplexer 20 may be arranged for receiving the bit stream BS as data packets or in other formats.

Although the accompanying drawings are primarily directed at devices, they also reflect the methods according to the present invention. More in particular, the inventive method of encoding a set of input signals (l, r) comprises the steps of:

converting (units 10 and 11) the set of input signals into a dominant signal (m) containing most signal energy, a residual signal (s) containing a remainder of the signal-energy, and signal parameters (IID, ICC) associated with the conversion, selecting (unit 15) parts of the residual signal (s), encoding (units 12 and 16) the dominant signal and the selected parts of the residual signal (s), wherein the selection step (unit 15) comprises the sub-steps of substantially passing perceptually relevant parts of the residual signal (s), attenuating perceptually less relevant parts of the residual signal and suppressing least relevant parts of the residual signal (as illustrated in FIGS. 8 and 9).

In addition, the method of decoding an input signal (BS) containing an encoded dominant signal containing most signal energy, an encoded residual signal containing a remainder of the signal energy, and associated signal parameters, comprises the steps of:

decoding (units 21 and 27) the encoded dominant signal and the encoded residual signal so as to produce a decoded dominant signal (m') and a decoded residual signal ($s'_{mod}$) respectively, deriving (unit 22) a synthetic residual signal ($s'_{syn}$) from the decoded dominant signal (m'), attenuating (unit 29) the synthetic residual signal ($s'_{syn}$) so as to produce an attenuated synthetic residual signal ($s'_{syn,mod}$), and combining (unit 28) the decoded residual signal ($s'_{mod}$) and the attenuated synthetic residual signal ($s'_{syn,\ mod}$) so as to produce a residual signal (s'), and converting the decoded dominant signal (m') and the reconstructed residual signal (s') into a set of output signals (l', r') using signal parameters (IID', ICC').

Further method steps may also be derived from the Figures.

The encoding methods and devices and decoding methods and devices of the present invention may be utilized in audio systems, solid state audio players (utilizing for example the well-known MP3 or AAC formats), electronic music distribution, internet radio, internet streaming, and other applications where audio coding may be advantageous.

The present invention is based upon the insight that, when encoding, the residual signal may be subdivided into at least three categories: perceptually relevant, less relevant and irrelevant, and that the residual signal may be attenuated accordingly. The present invention benefits from the further insight that, when decoding, the decoded residual signal may be used to control the attenuation of a synthetic residual signal to produce a reconstructed residual signal.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

What is claimed is:

1. An encoding device for encoding a set of input signals, the device comprising:

conversion means for converting the set of input signals into a dominant signal containing most signal energy, a residual signal containing a remainder of the signal energy, and signal parameters associated with the conversion;

selection means for selecting parts of the residual signal; and encoding means for encoding the dominant signal and the selected parts of the residual signal, wherein the selection means substantially passes perceptually relevant parts of the residual signal, attenuates perceptually less relevant parts of the residual signal, and suppresses least relevant parts of the residual signal.

2. The encoding device as claimed in claim 1, wherein the selection means includes a weighting function having at least three distinct weighting values.

3. The encoding device as claimed in claim 2, wherein the weighting function is time and/or frequency dependent.

4. The encoding device as claimed in claim 1, wherein said encoding device further comprises:

multiplexing means for multiplexing the encoded signals and the signal parameters into a combined output signal.

5. The encoding device as claimed in claim 1, wherein said encoding device further comprises:

quantization means quantizing the signal parameters.

6. An audio system, comprising an encoding device as claimed in claim 1.

7. A method of encoding a set of input signals, the method comprising the steps of:

converting the set of input signals into a dominant signal containing most signal energy, a residual signal containing a remainder of the signal energy, and signal parameters associated with the conversion;

selecting parts of the residual signal; and encoding the dominant signal and the selected parts of the residual signal, wherein the selecting step comprises the sub-steps of substantially passing perceptually relevant parts of the residual signal, attenuating perceptually less relevant parts of the residual signal, and suppressing least relevant parts of the residual signal.

8. The method as claimed in claim 7, wherein the selecting step involves a weighting function having at least three distinct weighting values.

9. The method as claimed in claim 8, wherein the weighting function is time and/or frequency dependent.

10. A non-transitory computer-readable medium containing a computer program for causing a computer, when executing said computer program, to carry out the encoding method as claimed in claim 7.

* * * * *